US005505821A

United States Patent [19]

Meinecke et al.

[11] Patent Number: 5,505,821

[45] Date of Patent: Apr. 9, 1996

[54] TURBULENCE INSERT OF A PAPERMAKING MACHINE

[75] Inventors: Albrecht Meinecke, Heidenheim; Helmut Heinzmann, Böhmenkirch, both of Germany

[73] Assignee: J. M. Voith GmbH, Heidenheim, Germany

[21] Appl. No.: 266,211

[22] Filed: Jun. 27, 1994

[30] Foreign Application Priority Data

Jun. 30, 1993 [DE] Germany ..... 43 21 697.8

[51] Int. Cl.[6] ..... D21F 1/06

[52] U.S. Cl. ..... 162/343; 162/216; 162/336

[58] Field of Search ..... 162/343, 336, 162/216

[56] References Cited

U.S. PATENT DOCUMENTS

| | | | |
|---|---|---|---|
| 3,514,372 | 5/1970 | Boyce et al. | 162/343 |
| 3,769,155 | 10/1973 | Schiel | 162/343 |
| 4,687,548 | 8/1987 | Ilmoniemi et al. | 162/216 |
| 4,784,726 | 11/1988 | Evalahti | 162/216 |
| 5,082,531 | 1/1992 | Takeuchi | 162/343 |

FOREIGN PATENT DOCUMENTS

| | | | |
|---|---|---|---|
| 4019593A1 | 1/1992 | Germany | D21F 1/02 |

*Primary Examiner*—Karen M. Hastings
*Attorney, Agent, or Firm*—Ohlandt, Greeley, Ruggiero & Perle

[57] ABSTRACT

A turbulence insert of a headbox of a papermaking machine is provided that includes a bundle of channels for guiding the suspension of materials from a first region to a second region. The channel bundle is comprised inpart of edge channels that have no adjacent channel on at least one longitudinal side, and is also comprised in part of central channels that have at least one adjacent channel on each longitudinal side. Also, at least two adjacent edge channels are provided that are joined with each other at least one part of their length.

7 Claims, 2 Drawing Sheets

TURBULENCE INSERT OF A PAPERMAKING MACHINE

BACKGROUND OF THE INVENTION

The pesent invention relates to a headbox of a papermaking machine, particularly the configuration of the turbulence insert in a headbox of a papermaking machine.

Headboxes of papermaking machines are generally described in German Patent No. DE 4,019,593 A1 to J. M. Voith GmbH, which issued on Jan. 9, 1992.

Tube bundles are utilized as rectifiers and turbulence generators in hydraulic headboxes of papermaking machines. The input cross section of an individual tube is circular and the tubes are arranged and worked in such a way that the outlet cross section is, for example, honeycomb-shaped, pentagonal, or even rectangular. The individual rows of a tube bundle packet may be displaced with respect to one another or may be arranged in flush manner. The individual tubes are closed up to the ends of the tube, i.e., their suspension flows do not have a hydraulic connection.

Viewed hydraulically, the following problems result at the outlet of the turbulence insert. Each jet from each individual tube has a velocity profile, which has very small values at the edges, corresponding to the profile of a tube flow. These edge zones are accelerated by pulse exchange with the core flow and with adjacent flows after release from the turbulence insert into the nozzle. In the case of flows from tubes positioned at the edges, the pulse exchange cannot take place on the edge side or the outside. The stays between the individual tubes thus have a long after-running extent with a smaller velocity than in the after-running of the tube center. This velocity profile cannot be completely equilibrated within the nozzle and leads to an adverse effect in jet quality in the free jet after leaving the nozzle and thus produces disturbances in the paper formation.

SUMMARY OF THE INVENTION

Against the foregoing background, it is a primary object of the present invention to provide a configuration of a turbulent insert such that the above described disadvantages, i.e., the unequal velocity distribution, is avoided.

To the accomplishment of the foregoing object, the present invention, in brief summary, comprises a plurality of channels for the suspension of materials from a first region to a second region, including at least two edge channels and at least one central channel; each of the edge channels having no adjacent channel on at least one longitudinal side; the central channel having at least one adjacent channel on each longitudinal side of the central channel; and at least two of the edge channels joined with each other along at least one portion of their length.

In addition, the present invention is also characterized by a hydraulic connection that is provided at an end region of the turbulence insert, a portion of at least two of the edge channels that terminates prior to a remaining portion of the channels, and a headbox that includes a plurality of layers of the channels.

The essential concept of the invention thus consists of the fact that the "brake effect" of the edge stays is reduced or eliminated by off-setting the latter from the flow wall (nozzle lameliar side), i.e., by keeping a distance between the flow wall and the stays of the turbulence tube on the edge side. In a preferred embodiment, this distance amounts to R≈2–10 mm.

BRIEF DESCRIPTION OF THE DRAWINGS

The invention is described in more detail on the basis of the figures.

The following are shown in the drawing:

FIG. 1 shows schematically a two-layer headbox in which a turbulence insert T is indicated on the left for each material layer, and this insert conducts the material suspension into the nozzle space. The nozzle space is formed by an upper cover O and a lower cover U of the headbox in which a lamella L is arranged centrally.

FIG. 2 shows section A-A through FIG. 1 in which the honeycomb-shaped ends of the turbulence tubes are to be viewed with their edge stays RS, whereby the lamella L passes between the turbulence insert of the upper and lower layer. RS indicates the edge stays of the individual turbulence tubes and RZ the respective upper and lower edge rows, i.e., the turbulence tubes lying one above the other, which are arranged at the edge. Further, the central inner rows are designated as IZ, i.e., the turbulence tubes whose closest neighbors represent other turbulence tubes and not walls.

FIG. 3 shows the same figure as FIG. 2, but the edge stays RS shown there are reduced by a length R, whereby according to the invention, a pulse exchange can occur between the individual material flows of the turbulence tubes at the edges, so that the undesired effects which arise by a pulse exchange that occurs first after the end of the turbulence tube are avoided.

FIG. 4 shows, for example, the configuration of an individual edge tube of a turbulence insert. A tube can be seen conically expanding from left to right at specific intervals, in which a routing was made at the upper edge of the last segment. In FIG. 6, section B—B of the individual tube of FIG. 4 is shown, whereby the honeycombed outlet side of the tube can be clearly recognized.

FIG. 5 shows once more a longitudinal section through a two-layer headbox with a turbulence insert according to the invention, in which the edge millings are clearly visible in the edge region of the turbulence insert.

Figure 1:
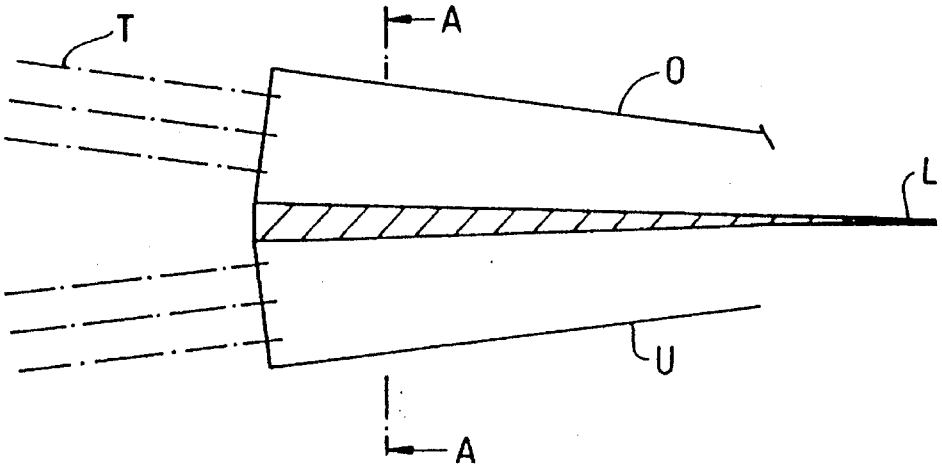
FIG. 1 is a longitudinal section view of a schematized headbox with nozzle, lamellae lying therein and tube bundle of the turbulence insert.
Figure 2:
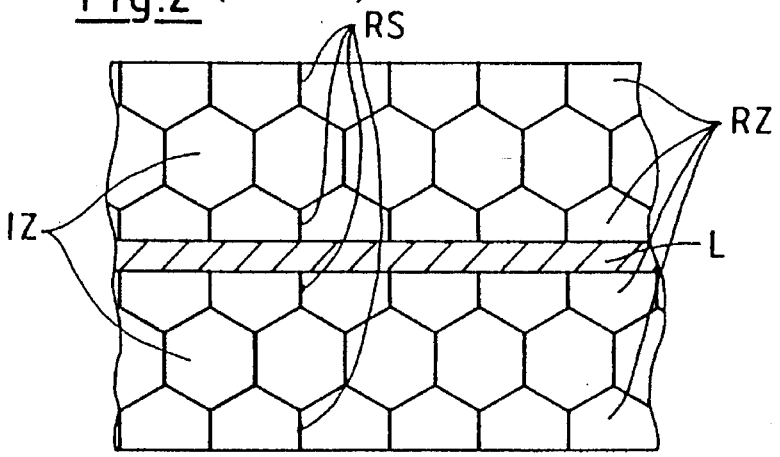
Fig.2 (Prior Art)
FIG. 2 is a cross-sectional view taken on line A—A of FIG. 1 with headbox according to the state of the art.
Figure 3:
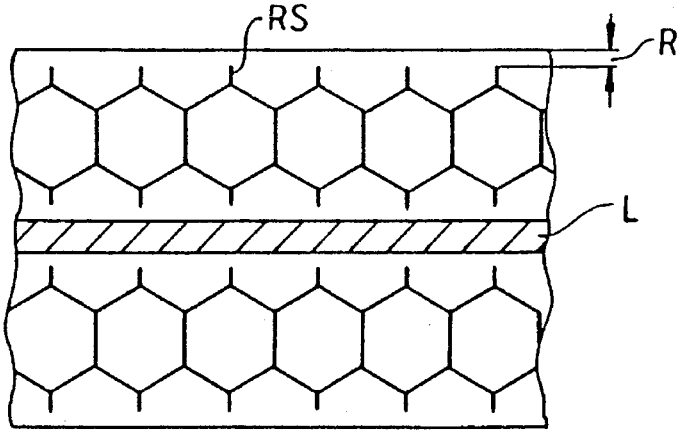
FIG. 3 is a cross-sectional view taken on line A—A of FIG. 1 with turbulence insert according to the invention.
Figure 6:
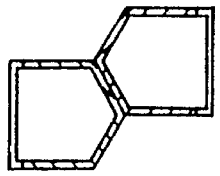
FIG. 6 is a cut-away view of the preferred embodiment showing two turbulence inserts joined along one longitudinal side.
Figure 4:
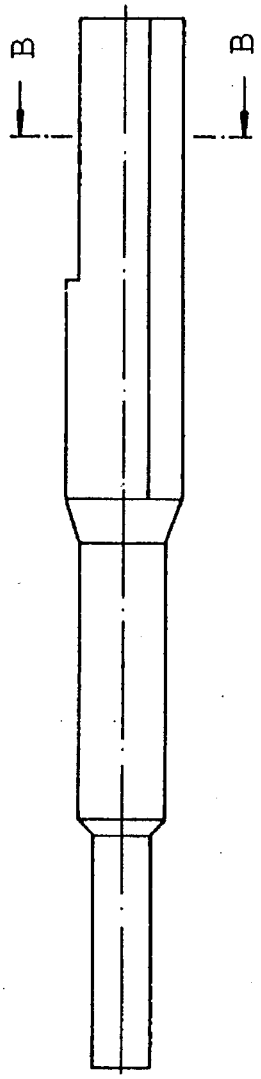
FIG. 4 is a longitudinal cross-section view of a single tube of a turbulent insert.
Figure 5:
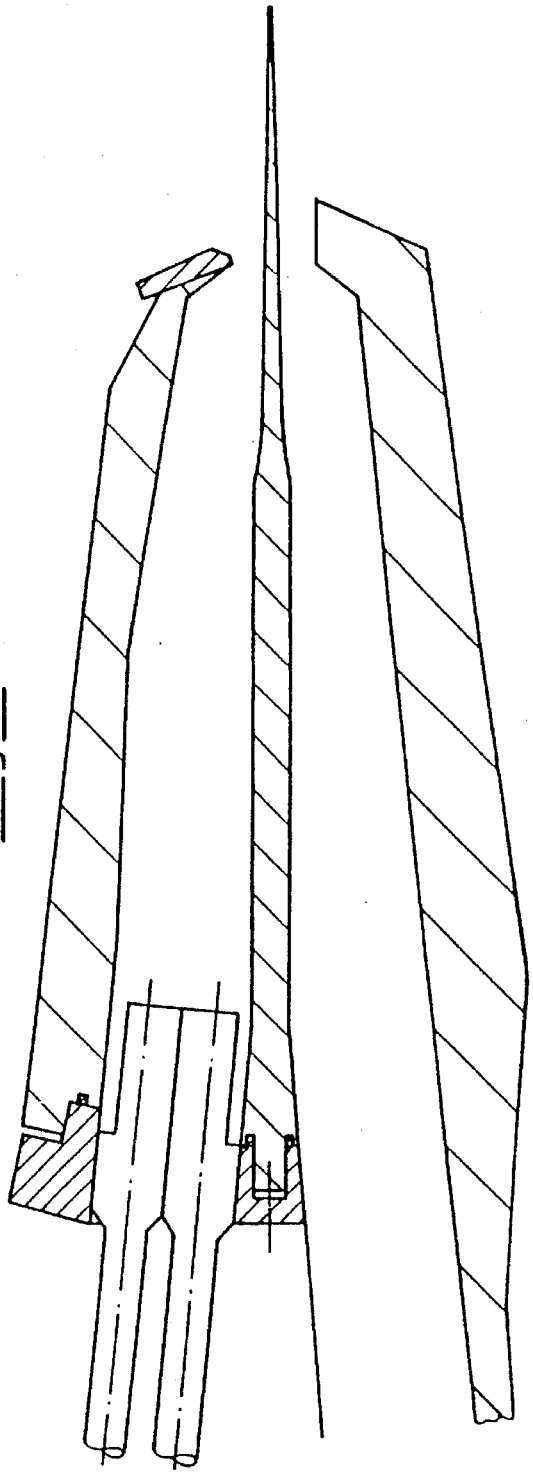
FIG. 5 is a longitudinal cross-section view through a headbox according to the invention with lamellae.

We claim:

1. A turbulence insert in a headbox of a papermaking machine, comprising:

a plurality of channels structured and arranged for guiding a suspension of materials from a first region to a second region, including at least two edge channels and at least one central channel;

each of said at least two edge channels being located on different longitudinal sides of said at least one central channel and having no adjacent channel on at least one longitudinal side, wherein said at least one longitudinal side is spaced a particular distance from an inner wall of the headbox;

said at least one central channel having at least one adjacent channel on each longitudinal side of said central channel; and said at least two edge channels being joined with each other along at least one portion of their length.

2. The turbulence insert according to claim 1, wherein said particular distance for spacing said at least one longitudinal side from the inner wall of the headbox is no greater than about 10 mm.

3. The turbulence insert according to claim 2, wherein said particular distance for spacing said at least one longitudinal side from the inner wall of the headbox is from about 2 mm to about 10 mm.

4. The turbulence insert according to claim 2, wherein the headbox is a multi-layer headbox.

5. The turbulence insert according to claim 1, wherein a hydraulic connection is provided at an end region of said turbulence insert.

6. The turbulence insert according to claim 1, wherein a portion of said at least two edge channels terminates prior to a remaining portion of said at least two edge channels.

7. The turbulence insert according to claim 1, wherein the headbox is a multi-layer headbox.

* * * * *